US008674881B2

(12) United States Patent
Suzuki

(10) Patent No.: US 8,674,881 B2
(45) Date of Patent: Mar. 18, 2014

(54) ANTENNA APPARATUS

(75) Inventor: Tomotaka Suzuki, Miyagi-Ken (JP)

(73) Assignee: ALPS Electric Co., Ltd., Tokyo (JP)

( * ) Notice: Subject to any disclaimer, the term of this patent is extended or adjusted under 35 U.S.C. 154(b) by 771 days.

(21) Appl. No.: 12/961,106

(22) Filed: Dec. 6, 2010

(65) Prior Publication Data

US 2011/0133992 A1 Jun. 9, 2011

(30) Foreign Application Priority Data

Dec. 7, 2009 (JP) ..... 2009-277773

(51) Int. Cl.
*H01Q 1/38* (2006.01)
*H01Q 1/24* (2006.01)
*H01Q 21/24* (2006.01)

(52) U.S. Cl.
USPC ..... 343/700 MS; 343/702; 343/853

(58) Field of Classification Search
USPC ..... 343/700 MS, 702, 795, 846, 853
See application file for complete search history.

(56) References Cited

U.S. PATENT DOCUMENTS 7,289,068 B2 * 10/2007 Fujio et al. ..... 343/700 MS
7,746,286 B2 * 6/2010 Suzuki ..... 343/833

FOREIGN PATENT DOCUMENTS

JP 2002-280828 9/2002
JP 2005-033736 2/2005

* cited by examiner

*Primary Examiner* — Michael C Wimer
(74) *Attorney, Agent, or Firm* — Hunton & Williams LLP

(57) ABSTRACT

In an antenna apparatus, two pattern antennas are arranged side by side in an area close to a ground conductor layer on a surface of a dielectric substrate, in such a manner as to be formed substantially line-symmetrical with each other. Each of the pattern antennas includes a radiation element having a feed coupler, a mutual coupler, and a feed element fed by a high frequency circuit unit. An open end of the radiation element is located near the ground conductor layer. The feed element and the feed coupler are capacitively coupled with each other, whereby the radiation element is excited. At the excitation, the mutual couplers that extend substantially in parallel with and close to each other are capacitively coupled with each other, and hence, polarization planes of the electric fields radiated from the radiation elements can be made orthogonal to each other.

4 Claims, 5 Drawing Sheets

ANTENNA APPARATUS

CLAIM OF PRIORITY

This application contains subject matter related to and claims benefit of Japanese Patent Application No. 2009-277773 filed on Dec. 7, 2009, the contents of which is incorporated herein by reference.

BACKGROUND OF THE DISCLOSURE

1. Field of the Disclosure

Embodiments of the disclosure relate to small antenna apparatuses suitable for polarization diversity antennas and multiple antennas for MIMO transmission, for example.

2. Description of the Related Art

A widely known example of such small antenna apparatuses has a configuration in which two chip antennas having an electric length of about ¼ of the wavelength λ of the frequency band used are arranged side by side on a dielectric substrate. However, in the antenna apparatus having such a configuration, if the distance between the chip antennas is not set to about λ/2, the two chip antennas interfere with each other, and hence predetermined antenna characteristics are not obtained. Consequently, when the 2.4 GHz frequency band is used, the two chip antennas need to be spaced apart from each other by about 6 cm, making the antenna apparatus unsuitable as an antenna apparatus which needs to be of reduced size.

Hence, to date, as described in Japanese Unexamined Patent Application Publication No. 2002-280828, for example, an antenna apparatus has been proposed which has a configuration in which two L-shaped pattern antennas made of metal conductor meandering lines are arranged side by side on the surface of a dielectric substrate, and each of the pattern antennas is made to operate as a center-feed dipole antenna having an electric length of about λ/2. In the proposed existing apparatus, the two pattern antennas are patterned so as to be L-shaped along one corner and the other corner of a side edge of the dielectric substrate, and the respective ends of the L-shaped antennas face each other with a relatively small gap therebetween. Since the antennas are arranged in such a manner that the polarization plane of the radiation electric field of one pattern antenna is orthogonal to the polarization plane of the radiation electric field of the other pattern antenna, the two antennas are highly isolated from each other and provide favorable antenna characteristics. Hence, the antenna apparatus which is favorable as, for example, a polarization diversity antenna can be easily reduced in size. Note that the meandering line is a known technology to obtain an increased electric length for a pattern antenna.

In the existing example disclosed in Japanese Unexamined Patent Application Publication No. 2002-280828, since the two L-shaped pattern antennas with the ends of the L shapes thereof facing each other are fed at the respective center portions, the distance between the feeding points of the pattern antennas unavoidably becomes large. Hence, in such an existing example, long and complex wiring patterns need to be formed to connect the feeding points of the pattern antennas to a high frequency circuit, thereby prohibiting decreased cost and freedom of design.

These and other drawbacks exist.

SUMMARY OF THE DISCLOSURE

In view of the problems of the existing technology described above, embodiments of the disclosure provide an antenna apparatus realizing favorable isolation of two pattern antennas arranged side by side, easy reduction in size, and less complex wiring for connection between the antennas and a high frequency circuit.

Various embodiments provide an antenna apparatus including two pattern antennas made of a metal conductor arranged, on a first surface of a dielectric substrate, side by side in an area close to a ground conductor layer, where each of the pattern antennas includes: a radiation element having an electric length of about half a wavelength of a frequency band used, a portion close to one end of the radiation element being a feed coupler; and a feed element that receives a feed signal from a high frequency circuit unit and that is capacitively coupled with the feed coupler. The two pattern antennas are formed in shapes substantially line symmetric with each other, and a portion of the radiation element is made to be a mutual coupler that extends in such a manner as to be substantially in parallel with and adjacent to a symmetry axis of the two antennas. An end of the mutual coupler nearer to the ground conductor layer is connected to the feed coupler, and a portion of the radiation element winding and extending from the other end of the mutual coupler is made to have an open end near the ground conductor layer. The respective mutual couplers of the two pattern antennas are capacitively coupled with each other.

In the antenna apparatus configured as described above, when the radiation element of each pattern antenna is excited, since the voltage near the end of the feed coupler farther from the ground layer and the voltage near the open end vary widely, each pattern antenna can be made to operate similarly to a dipole antenna which resonates at about half the wavelength λ of the frequency band used. In addition, since the polarization plane of the electric field radiated from one antenna can be made to be substantially orthogonal to the polarization plane of the electric field radiated from the other antenna, the two pattern antennas are effectively prevented from interfering with each other. Hence, the antenna apparatus can be applied to a polarization diversity antenna and multiple antennas for MIMO transmission, for example. Further, since the mutual couplers of the two pattern antennas are arranged substantially in parallel with and close to each other, the whole antenna apparatus can be easily reduced in size. In addition, since the feed elements of the pattern antennas need not be widely spaced apart from each other, wiring for connecting the feed elements to the high frequency circuit unit is prevented from becoming complex.

In the configuration described above, the feed coupler may be provided on the first surface of the dielectric layer, and the feed element may be provided on a second surface of the dielectric layer. In this case, both sides of the dielectric substrate are effectively used, resulting in an increased space factor, and the degree of coupling between the feed elements and the feed couplers is increased, since the dielectric substrate exists therebetween.

In the configuration described above, the radiation element may have a first auxiliary pattern connected to the mutual coupler through a first through hole, and a second auxiliary pattern connected to a portion near the open end through a second through hole. In this case, the radiation elements have substantially increased thicknesses at the positions where the voltages vary widely, and hence, the strengths of the radiated electric fields are likely to be increased.

In the configuration described above, the radiation element may have an adjustment pattern that continuously extends to the feed coupler or the open end. In this case, the antenna characteristics can be favorably adjusted.

DETAILED DESCRIPTION OF THE DISCLOSURE

The following description is intended to convey a thorough understanding of the embodiments described by providing a number of specific embodiments and details involving antenna apparatuses. It should be appreciated, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments, depending on specific design and other needs.

Figure 1:
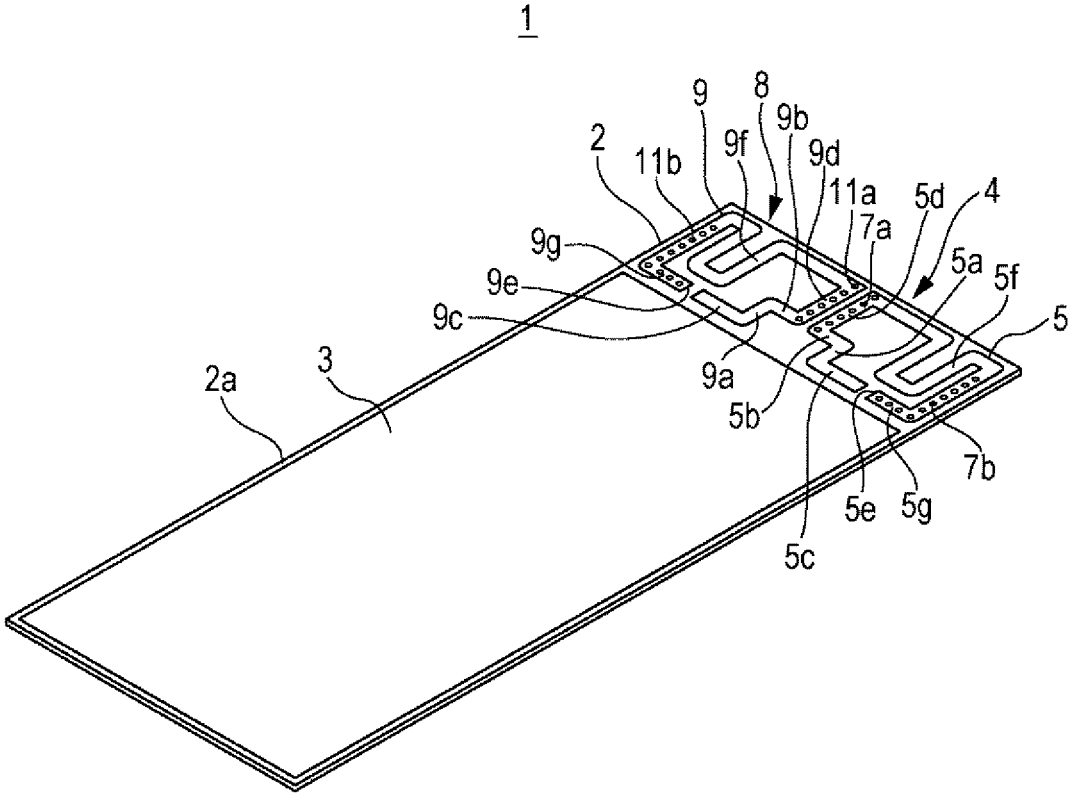
FIG. 1 is a perspective view of an antenna apparatus according to a first embodiment of the disclosure.
Figure 2:
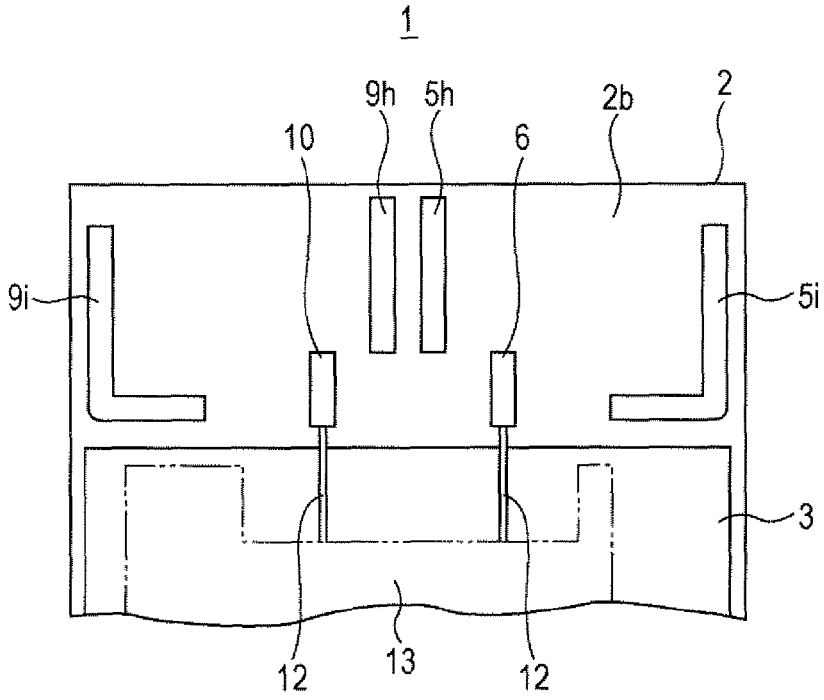
FIG. 2 is a plan view of major portions of the antenna apparatus, illustrating a surface opposite the surface illustrated in FIG. 1.
Figure 3:
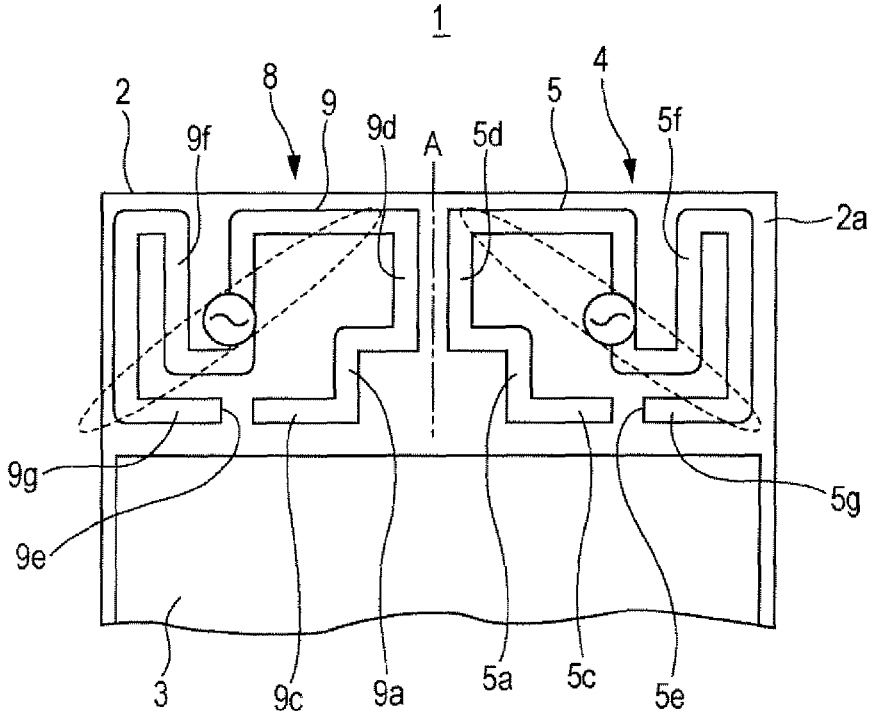
FIG. 3 is an explanatory illustration of the operation of the antenna apparatus according to an embodiment of the disclosure.

Referring to FIGS. 1 to 3, an exemplary embodiment of the disclosure is described. An antenna apparatus 1 illustrated in FIGS. 1 to 3 may have a configuration in which two pattern antennas 4 and 8 made of a metal conductor are arranged side by side in an area adjacent to a ground conductor layer (ground pattern) 3 at an end edge of a dielectric substrate 2. The pattern antenna 4 may include a radiation element 5 and a feed element 6. The pattern antenna 8 may include a radiation element 9 and a feed element 10. These two pattern antennas 4 and 8 may be formed in shapes which may be substantially line-symmetric with each other with respect to a symmetry axis A (see FIG. 3).

Regarding the pattern antenna 4, which is one of the two pattern antennas, the radiation element 5 may be formed on one surface 2*a* of the dielectric substrate 2 as a predetermined strip pattern. A portion of the strip pattern near the end of the strip pattern may be a feed coupler 5*a*, which may be substantially parallel with the symmetry axis A. The feed coupler 5*a* and the feed element 6 formed on the other surface 2*b* of the dielectric substrate 2 may be opposite each other with the dielectric substrate 2 therebetween. Referring to FIG. 2, the feed element 6 may be connected to a micro strip line 12. The micro strip line 12 may be connected to a high frequency circuit unit 13 which may be arranged on the surface 2*b* of the dielectric substrate 2. By supplying a feed signal from the high frequency circuit unit 13 to the feed element 6 through the micro strip line 12, the feed signal is supplied to the feed coupler 5*a* which may be capacitively coupled with the feed element 6, whereby the radiation element 5 is excited. In such an embodiment, the high frequency circuit unit 13 may be covered with a shielding cover, which is not illustrated.

The portion of the strip pattern of the radiation element 5 other than the feed coupler 5*a* may be divided into a first adjustment pattern 5*b* which may extend from an end of the feed coupler 5*a* toward the symmetry axis A, a second adjustment pattern 5*c* which may extend from the other end of the feed coupler 5*a* in the opposite direction to the first adjustment pattern 5*b* over and close to the ground conductor layer 3, a mutual coupler 5*d* which may extend toward the opposite side of the ground conductor layer 3 (farther from the ground conductor layer) along the symmetry axis A, and the remaining portion which may extend and wind from the mutual coupler 5*d* to an open end 5*e*. The mutual coupler 5*d* may neighbor the symmetry axis A. In the remaining portion, a meandering portion 5*f* may be formed at an appropriate point along the strip pattern to increase the electric length, and a third adjustment pattern 5*g* also may be formed, which may extend to the open end 5*e* in such a manner as to neighbor the ground conductor layer 3. The open end 5*e* faces the leading end of the second adjustment pattern 5*c*. Auxiliary patterns 5*h* and 5*i*, which are the constituents of the radiation element 5, may be formed on the surface 2*b* of the dielectric substrate 2. The auxiliary pattern 5*h*, which is a straight strip pattern, is connected to the mutual coupler 5*d* through a plurality of through holes 7*a*. The auxiliary pattern 5*i*, which may be an L-shaped strip pattern, may be connected to the L-shaped portion (including the third adjustment pattern 5*g*) near the open end 5*e* through a plurality of through holes 7*b*.

The pattern antenna 8 may be formed in a shape substantially line-symmetric with that of the pattern antenna 4 described above, and the detailed description thereof is omitted here. An radiation element 9 of the pattern antenna 8 may also include: a feed coupler 9*a*, first to third adjustment patterns 9*b*, 9*c*, and 9*g*; a mutual coupler 9*d*; a meandering portion 9*f*, auxiliary patterns 9*h* and 9*i*, and the like, and an open end 9*e* faces the leading end of the second adjustment pattern 9*c*. By supplying a feed signal from the high frequency circuit unit 13 to the feed element 10, which is formed on the surface 2*b* of the dielectric substrate 2, through a micro strip line 12, the feed signal may be supplied to the feed coupler 9*a* which may be capacitively coupled with the feed element 10, whereby the radiation element 9 is excited. Since the mutual coupler 9*d* of the radiation element 9 may extend in such a manner as to be substantially in parallel with and adjacent to the symmetry axis A, when the radiation elements 5 and 9 of both the pattern antennas 4 and 8 are excited, the mutual couplers 5*d* and 9*d* may be coupled with each other. Note that, similarly to the pattern antenna 4 described above, the mutual coupler 9*d* of the pattern antenna 8 may be connected to the auxiliary pattern 9*h* through a plurality of through holes 11*a*, and an L-shaped portion (including the third adjustment pattern 9*g*) near the open end 9*e* may be connected to the auxiliary pattern 9*i* through a plurality of through holes 11*b*.

The operations of the two pattern antennas 4 and 8 will now be described. The radiation elements 5 and 9 may be excited when feed signals are supplied to the feed couplers 5*a* and 9*a* which are respectively coupled with the feed elements 6 and 10. Referring to the image of the operation illustrated in FIG. 3, when the radiation element 5 is excited, since the voltage near the end of the feed coupler 5*a* farther from the ground layer and the voltage near the open end 5*e* vary widely, the pattern antenna 4 can be made to operate similarly to a dipole antenna which resonates at about half the wavelength λ of the frequency band used. Similarly, when the radiation element 9 is excited, since the voltage near the end of the feed coupler 9*a* farther from the ground layer and the voltage near the open end 9*e* vary widely, the pattern antenna 8 can be made to operate similarly to a dipole antenna which resonates at about λ/2. Hence, referring to FIG. 3, the polarization plane of the electric field radiated from the radiation element 5 can be made substantially orthogonal to the polarization plane of the electric field radiated from the radiation element 9, whereby favorable isolation of the pattern antennas 4 and 8 from each other is realized.

Note that, in the present embodiment, to make the polarization plane of the electric field radiated from the pattern antenna 4 substantially orthogonal to the polarization plane of the electric field radiated from the pattern antenna 8, the lengths of the first to third adjustment patterns 5*b*, 5*c*, and 5*g* of the radiation element 5 and the lengths of the first to third adjustment patterns 9*b*, 9*c*, and 9*g* of the radiation element 9 are adjusted.

As described above, in the antenna apparatus 1 according the present embodiment, the radiation elements 5 and 9 can be made to resonate at about half the wavelength λ of the frequency band used and the polarization planes of the electric fields radiated from the respective radiation elements 5 and 9 can be made to be substantially orthogonal to each other, whereby realizing favorable isolation of the pattern antennas 4 and 8 arranged side by side. Hence, the antenna apparatus 1 is suitable for a polarization diversity antenna and multiple antennas for MIMO transmission, for example. In addition, since the mutual couplers 5*d* and 9*d* of the two pattern antennas 4 and 8 are arranged substantially in parallel with and close to each other, the antenna apparatus 1 can be easily reduced in size. Further, the feed elements 6 and 10 of the pattern antennas 4 and 8 need not be widely spaced apart from each other, and the feed elements 6 and 10 can be connected to the high frequency circuit unit 13 using the short micro strip lines 12, resulting in simple and low cost wiring for connecting the feed elements 6 and 10 to the high frequency circuit unit 13 and relatively easy change of design.

In addition, in the antenna apparatus 1 according to the present embodiment, the feed couplers 5*a* and 9*a* may be provided on the surface 2*a* of the dielectric substrate 2, and the feed elements 6 and 10 may be provided on the other surface 2*b*. In this case, both sides of the dielectric substrate 2 are effectively used, resulting in an increased space factor. This also enables a reduction in size. Further, the degree of coupling between the feed element 6 and the feed coupler 5*a* and the degree of coupling between the feed element 10 and the feed coupler 9*a* may be increased, since the dielectric substrate 2 exists therebetween.

In addition, in the antenna apparatus 1 according to the present embodiment, the mutual couplers 5*d* and 9*d* of the radiation elements 5 and 9 may be connected respectively to the auxiliary pattern 5*h* and 9*h* through the through holes 7*a* and 11*a*, and the L-shaped portions near the open ends 5*e* and 9*e* may be connected respectively to the auxiliary patterns 5*i* and 9*i* through the through holes 7*b* and 11*b*. In other words, the radiation elements 5 and 9 have substantially increased thicknesses at the positions where the voltages vary widely, and hence, the strengths of the radiated electric fields are likely to be increased.

In addition, in the antenna apparatus 1 according to the present embodiment, the radiation element 5 may include the first to third adjustment patterns 5*b*, 5*c*, and 5*g*, and the radiation element 9 may include the first to third adjustment patterns 9*b*, 9*c*, and 9*g*, and by adjusting the lengths of these adjustment patterns, the antenna characteristics can be adjusted. Hence, it is relatively easy to perform fine adjustment of electric lengths, the directions of polarization planes, and the like.

Figure 4:
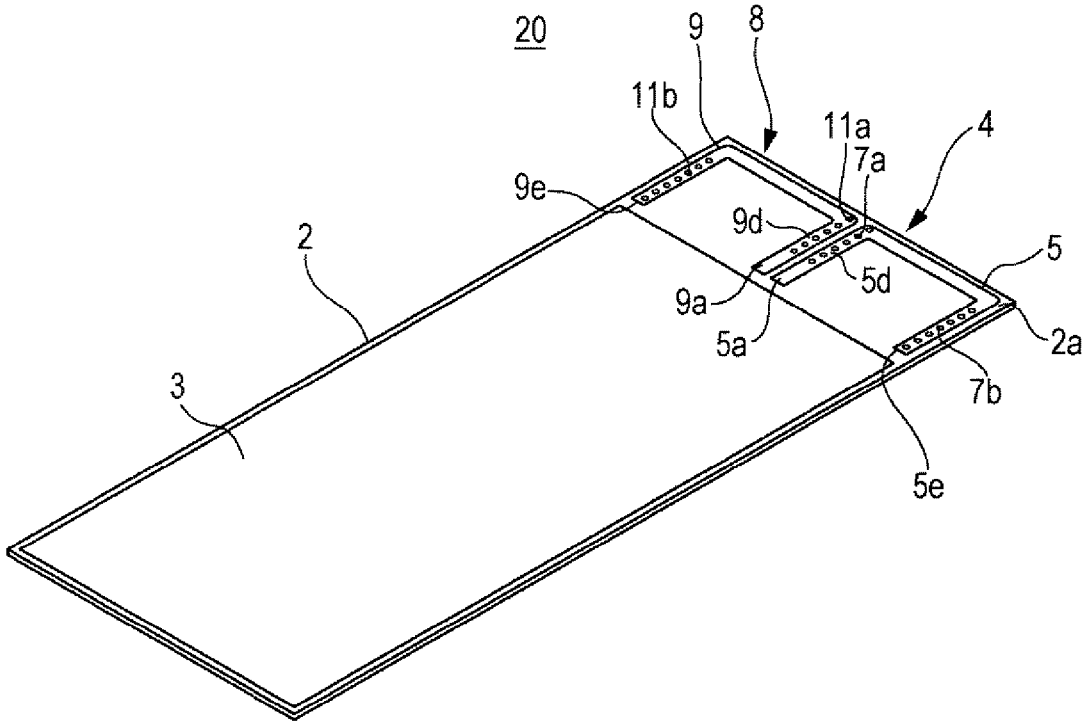
FIG. 4 is a perspective view of an antenna apparatus according to an embodiment of the disclosure.

FIG. 4 is a perspective view of an antenna apparatus according to an exemplary embodiment of the disclosure. In FIG. 4, components corresponding to those in FIG. 1 are denoted by the same reference numerals, and duplicated descriptions thereof are omitted. An antenna apparatus 20 illustrated in FIG. 4 is an example in which radiation elements 5 and 9 of pattern antennas 4 and 8 are formed in very simplified shapes, where the meandering portions, the adjustment patterns, and the like of the first embodiment described above are omitted. In other words, in the antenna apparatus 20, the radiation elements 5 and 9 are respectively formed as substantially U-shaped strip patterns, on a surface 2*a* of a dielectric substrate 2. Feed couplers 5*a* and 9*a*, which may be capacitively coupled with respective feed elements (not illustrated) provided on the other surface of the dielectric substrate 2, are formed as strip portions which are realized by extending respective mutual couplers 5*d* and 9*d* toward the ground conductor layer 3 side. Note that respective auxiliary patterns (not illustrated) connected to through holes 7*a* and 7*b* and respective auxiliary patterns (not illustrated) connected to through holes 11*a* and 11*b* are all formed in straight strip patterns substantially in parallel with each other on the other surface of the dielectric substrate 2, as respective constituents of the radiation elements 5 and 9.

Figure 5:
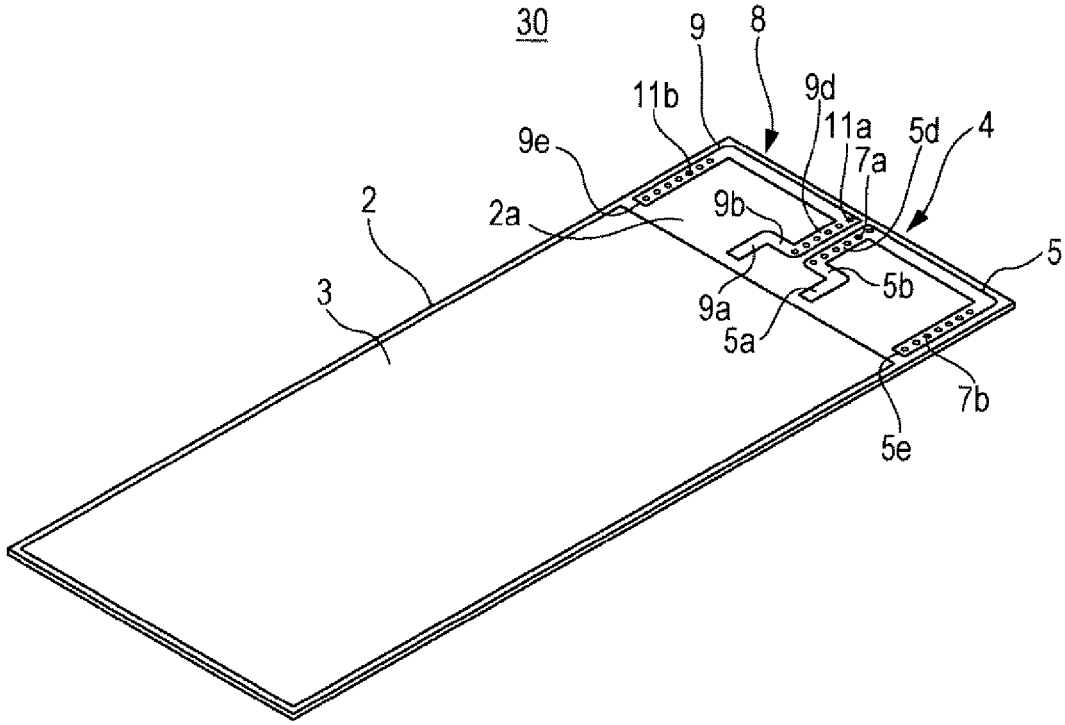
FIG. 5 is a perspective view of an antenna apparatus according to an embodiment of the disclosure.

FIG. 5 is a perspective view of an antenna apparatus according to an exemplary embodiment of the disclosure. In FIG. 5, components corresponding to those in FIG. 1 or 4 are denoted by the same reference numerals, and duplicated descriptions thereof are omitted. An antenna apparatus 30 illustrated in FIG. 5 is different from the second embodiment described above in that radiation elements 5 and 9 of pattern antennas 4 and 8 respectively may include first adjustment patterns 5*b* and 9*b*, and the distance between feed couplers 5*a* and 9*a* may be increased a little.

Figure 6:
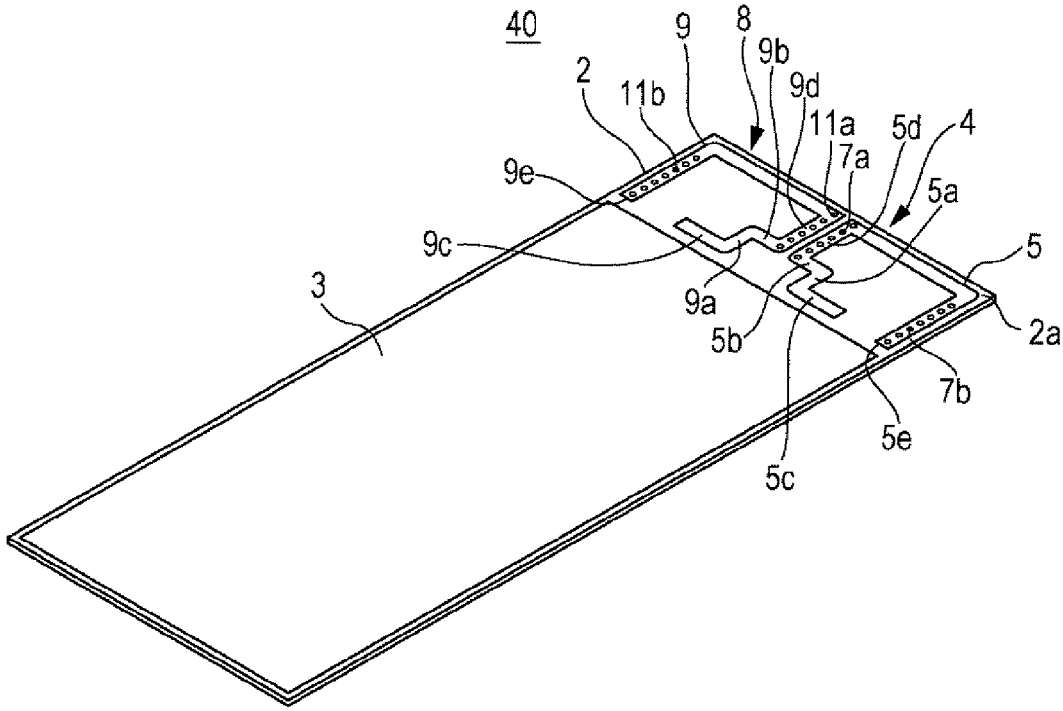
FIG. 6 is a perspective view of an antenna apparatus according to an embodiment of the disclosure.

FIG. 6 is a perspective view of an antenna apparatus according to an exemplary embodiment of the present disclosure. In FIG. 6, components corresponding to those in FIG. 1 or 5 are denoted by the same reference numerals, and duplicated descriptions thereof are omitted. An antenna apparatus 40 illustrated in FIG. 6 is different from the third embodiment described above in that radiation elements 5 and 9 of pattern antennas 4 and 8 respectively may include not only first adjustment patterns 5*b* and 9*b*, but also second adjustment patterns 5*c* and 9*c*.

Figure 7:
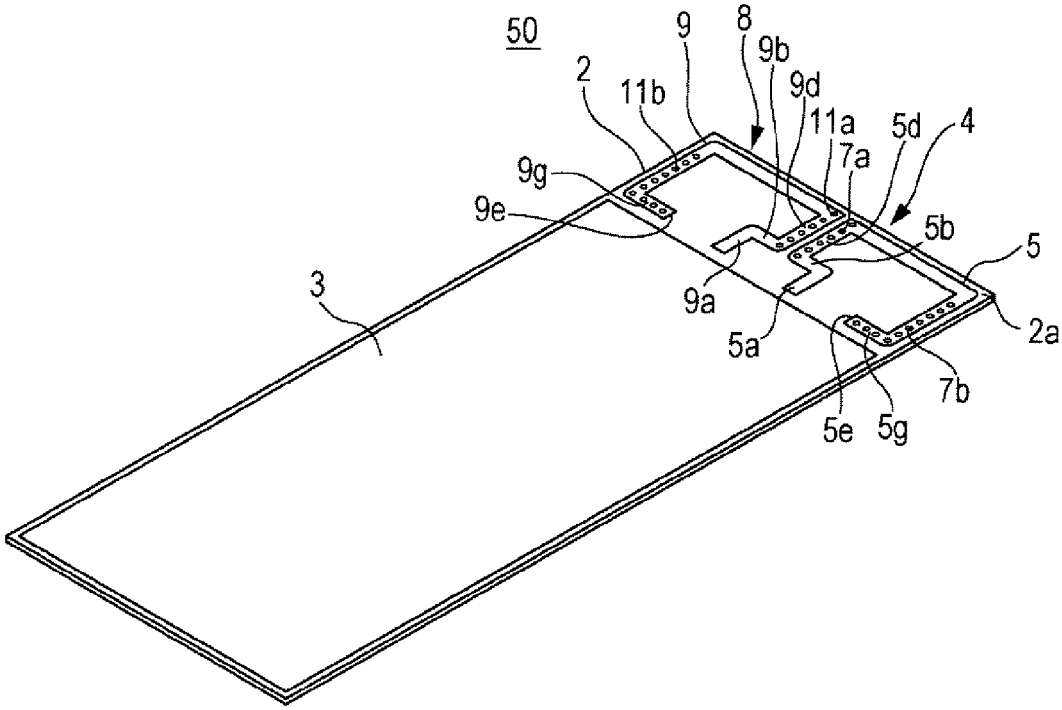
FIG. 7 is a perspective view of an antenna apparatus according to an embodiment of the disclosure.

FIG. 7 is a perspective view of an antenna apparatus according to an exemplary embodiment of the disclosure. In FIG. 7, components corresponding to those in FIG. 1 or 5 are denoted by the same reference numerals, and duplicated descriptions thereof are omitted. An antenna apparatus 50 illustrated in FIG. 7 is different from the third embodiment described above in that radiation elements 5 and 9 of pattern antennas 4 and 8 respectively may include not only first adjustment patterns 5*b* and 9*b*, but also third adjustment patterns 5*g* and 9*g* on the open ends 5*e* and 9*e* sides. Note that, in such an embodiment, auxiliary patterns (not illustrated), which may be provided on the back surface of a dielectric substrate 2 in FIG. 7 and connected to through holes 7*b* and 11*b*, may be formed in L-shapes similarly to the first embodiment described above.

Figure 8:
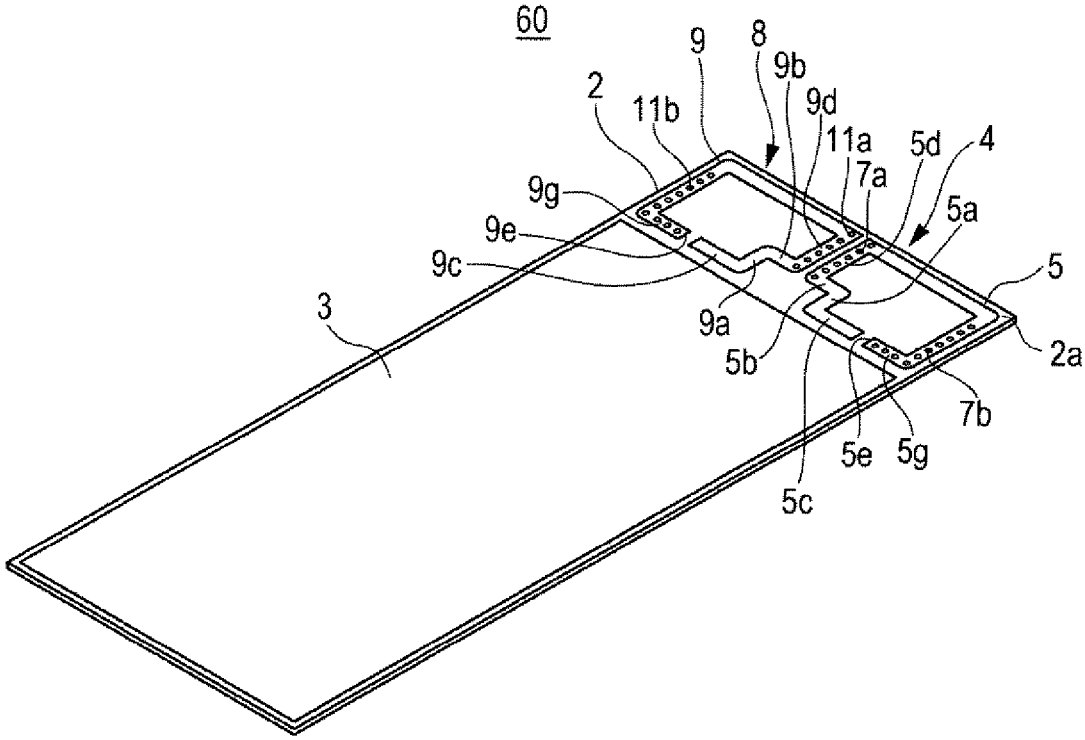
FIG. 8 is a perspective view of an antenna apparatus according to an embodiment of the disclosure.

FIG. 8 is a perspective view of an antenna apparatus according to am exemplary embodiment of the disclosure. In FIG. 8, components corresponding to those in FIG. 1 are denoted by the same reference numerals, and duplicated descriptions thereof are omitted. An antenna apparatus 60 illustrated in FIG. 8 is different from the first embodiment described above in that radiation elements 5 and 9 of pattern antennas 4 and 8 do not include the meandering potions. Although the radiation elements 5 and 9 may not include the meandering portions like this, part of the radiation elements 5 and 9 may be formed as meandering portions to increase the electric lengths when a reduction in size is particularly required.

Figure 9:
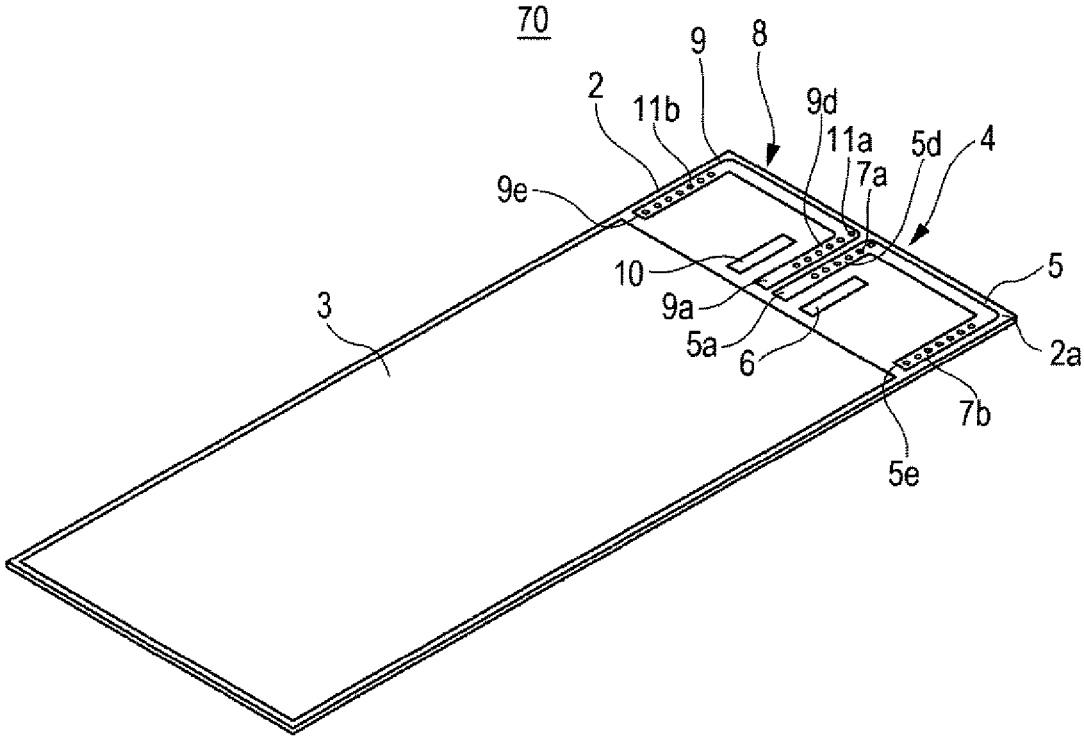
FIG. 9 is a perspective view of an antenna apparatus according to an embodiment of the disclosure.

FIG. 9 is a perspective view of an antenna apparatus according to an exemplary embodiment of the disclosure. In FIG. 9, components corresponding to those in FIG. 2 or 4 are denoted by the same reference numerals, and duplicated descriptions thereof are omitted. An antenna apparatus 70 illustrated in FIG. 9 is different from the second embodiment described above in that feed elements 6 and 10 of pattern antennas 4 and 8 may be respectively provided on a surface 2*a* in such a manner as to be substantially in parallel with and adjacent to feed couplers 5*a* and 9*a*. In this manner, when there is space for arranging the feed elements 6 and 10 near the feed couplers 5*a* and 9*a* of radiation elements 5 and 9, it is possible to arrange the feed elements 6 and 10 and the feed couplers 5*a* and 9*a* side by side on the same plane. Also in the third and fifth embodiments described above, for example, a design modification is possible such that the feed element 6 is arranged so as to be substantially in parallel with and adjacent to the right side of the feed coupler 5*a* in the figures and the feed element 10 is arranged so as to be substantially in parallel with and adjacent to the left side of the feed element 10 in the figures.

The embodiments of the present inventions are not to be limited in scope by the specific embodiments described herein. Further, although some of the embodiments of the present invention have been described herein in the context of a particular implementation in a particular environment for a particular purpose, those of ordinary skill in the art should recognize that its usefulness is not limited thereto and that the embodiments of the present inventions can be beneficially implemented in any number of environments for any number of purposes. Accordingly, the claims set forth below should be construed in view of the full breadth and spirit of the embodiments of the present inventions as disclosed herein. While the foregoing description includes many details and specificities, it is to be understood that these have been included for purposes of explanation only, and are not to be interpreted as limitations of the invention. Many modifications to the embodiments described above can be made without departing from the spirit and scope of the invention.

What is claimed is:

1. An antenna apparatus comprising:

two pattern antennas made of a metal conductor arranged, on a first surface of a dielectric substrate, side by side in an area close to a ground conductor layer, wherein each of the pattern antennas includes:

a radiation element having an electric length of about half a wavelength of a frequency band used, a portion close to one end of the radiation element being a feed coupler, and a feed element that receives a feed signal from a high frequency circuit unit and that is capacitively coupled with the feed coupler, wherein the two pattern antennas are formed in shapes substantially line symmetric with each other, and a portion of the radiation element is made to be a mutual coupler that extends in such a manner as to be substantially in parallel with and adjacent to a symmetry axis of the two antennas, wherein an end of the mutual coupler nearer to the ground conductor layer is connected to the feed coupler and a portion of the radiation element winding and extending from the other end of the mutual coupler is made to have an open end near the ground conductor layer, and wherein the respective mutual couplers of the two pattern antennas are capacitively coupled with each other.

2. The antenna apparatus according to claim 1, wherein the feed coupler is provided on the first surface of the dielectric substrate, and the feed element is provided on a second surface of the dielectric substrate.

3. The antenna apparatus according to claim 1, wherein the radiation element has a first auxiliary pattern connected to the mutual coupler through a first through hole, and a second auxiliary pattern connected to a portion near the open end through a second through hole.

4. The antenna apparatus according to claim 1, wherein the radiation element has an adjustment pattern that continuously extends to the feed coupler or the open end.

* * * * *